US010639655B2

(12) United States Patent
Waineo et al.

(10) Patent No.: US 10,639,655 B2
(45) Date of Patent: May 5, 2020

(54) ELECTROSTATIC BARRIER FOR A ROBOTIC PAINTING SYSTEM FOR CONDUCTIVE MATERIALS

(71) Applicant: Fanuc America Corporation, Rochester Hills, MI (US)

(72) Inventors: Douglas B. Waineo, Bloomfield Hills, MI (US); Ernest M. Otani, West Bloomfield, MI (US)

(73) Assignee: FANUC AMERICA CORPORATION, Rochester Hills, MI (US)

( * ) Notice: Subject to any disclaimer, the term of this patent is extended or adjusted under 35 U.S.C. 154(b) by 378 days.

(21) Appl. No.: 14/065,780

(22) Filed: Oct. 29, 2013

(65) Prior Publication Data

US 2015/0118439 A1 Apr. 30, 2015

(51) Int. Cl.
*B05B 5/025* (2006.01)
*B05B 5/16* (2006.01)
(Continued)

(52) U.S. Cl.
CPC ..... *B05B 5/025* (2013.01); *B05B 5/1608* (2013.01); *B05B 5/1616* (2013.01);
(Continued)

(58) Field of Classification Search
CPC ..... Y10S 901/43; Y10T 428/24174; Y10T 428/31544; Y10T 428/3154;
(Continued)

(56) References Cited

U.S. PATENT DOCUMENTS 5,335,854 A * 8/1994 Seitz ..... B05B 5/1608 118/300
5,843,536 A * 12/1998 Scharfenberger ..... B05B 5/053 427/483

(Continued)

FOREIGN PATENT DOCUMENTS

JP S6235417 A 2/1987
JP 2003054645 A 2/2003
WO WO-2014103116 A1 * 7/2014 ..... B05B 5/1625

OTHER PUBLICATIONS

"Flange". Wikipedia. Archived Sep. 16, 2012. web.archive.org/web/20120916224646/http://en.wikipedia.org/wiki/Flange.*
"Insulating Materials List". Professional Plastics. Feb. 1, 2001. PDF available at: www.professionalplastics.com/professionalplastics/InsulatingMaterialsList.pdf.*

(Continued)

*Primary Examiner* — Maria V Ewald
*Assistant Examiner* — Ethan A. Utt
(74) *Attorney, Agent, or Firm* — John A. Miller; Shumaker, Loop & Kendrick, LLP

(57) ABSTRACT

A robotic electrostatic painting system includes a barrier formed from an electrical insulating material and disposed between adjacent reservoirs for holding a conductive paint used in an electrostatic painting operation. The barrier is shaped and dimensioned with a central plate and upper and lower flanges to block every straight line path between the reservoirs to electrostatically separate the reservoirs and prevent the formation of a ground path or short circuit when there is a voltage difference between the reservoirs. The electrostatic separation of the reservoirs further prevents deterioration of conductive components of the robotic electrostatic painting system.

20 Claims, 2 Drawing Sheets

(51) Int. Cl.
*H01B 3/42* (2006.01)
*H01B 3/44* (2006.01)

(52) U.S. Cl.
CPC ..... *B05B 5/1675* (2013.01); *H01B 3/428* (2013.01); *H01B 3/445* (2013.01); *Y10S 901/43* (2013.01); *Y10T 428/24174* (2015.01); *Y10T 428/31544* (2015.04); *Y10T 428/31942* (2015.04)

(58) Field of Classification Search
CPC ..... Y10T 428/24777; Y10T 428/24793; B05B 5/025; B05B 5/0255; B05B 12/14; B05B 5/16; B32B 3/02; B32B 3/06; B32B 3/08; H01B 3/42; H01B 3/428; H01B 3/44; H01B 3/443; H01B 3/445
USPC ..... 901/43; 428/119, 422, 421, 192, 194
See application file for complete search history.

(56) References Cited

U.S. PATENT DOCUMENTS

2005/0173018 A1* 8/2005 Herre ..... B05B 5/1616 141/91
2006/0019036 A1* 1/2006 Herre ..... B05B 5/1625 239/3
2015/0190822 A1* 7/2015 Kobayashi ..... B05B 5/1625 118/621

OTHER PUBLICATIONS

"Polyoxymethylene". Wikipedia. Archived May 9, 2012. web.archive.org/web/20120509211116/http://en.wikipedia.org/wiki/Polyoxymethylene.*

* cited by examiner

ELECTROSTATIC BARRIER FOR A ROBOTIC PAINTING SYSTEM FOR CONDUCTIVE MATERIALS

FIELD OF THE INVENTION

The present invention relates to a robotic electrostatic painting system for applying electrically conductive paint to an object, and more particularly, to an electrostatic barrier formed between an electrostatically charged paint reservoir and a grounded paint reservoir to prevent deterioration of the robotic electrostatic painting system.

BACKGROUND OF THE INVENTION

Robotic electrostatic painting systems for conductive paints fall into two broad categories: "direct charge" systems which apply an electrostatic charge directly to an amount of paint that is electrostatically isolated from ground; and "indirect charge or corona charging" systems which use electrodes to apply or induce a charge on a paint spray cloud in such a way that the paint can be continuously supplied from a grounded paint supply.

This invention relates to a specific problem that exists for "direct charge" systems that employ two or more reservoirs for holding the conductive paint, wherein the two or more reservoirs are mounted in close proximity to each other on a robot arm of the robotic electrostatic painting system. In this configuration, it is desirable to enable a state in which one reservoir is isolated from ground potential and electrostatically charged to perform a painting operation while another reservoir is grounded while being filled with conductive paint from a grounded paint supply. The most advantageous location for these two (or more reservoirs) is near each other, usually mounted on the same link of the robot arm used for applying the paint to an object such as a vehicle body.

Two (or more) such reservoirs, mounted, by necessity, so close together produce a very strong electric field when one reservoir is charged and the other(s) are grounded. Over time this electric field can cause deterioration of painting components thereby compromising the system. This deterioration is sometimes called "electrostatic etching" or "pinholing," and ultimately results in a ground path or short circuit between the reservoirs, preventing the effective charging of the dispensing reservoir.

Electrostatic etching of seals or enclosures can occur in a matter of several minutes or can develop over many months of service, depending on the design and circumstances of use. To be included in a reliable system for industrial use, the components of the robotic electrostatic painting system in close proximity to the reservoirs must resist such deterioration for a minimum of several months of use.

Accordingly, it would be desirable to produce a barrier system for electrostatically insulating adjacent conductive paint reservoirs from one another to prevent the formation of a ground path or short circuit between the adjacent conductive paint reservoirs.

SUMMARY OF THE INVENTION

This invention relates to a barrier design that resists the creation of a ground path between reservoirs over the course of many months of use. The invention comprises a barrier fabricated from material having a high di-electric strength, such as PTFE material, and with a shape designed to block any "line of sight" path between reservoirs and cause the shortest path on the surface of the components to be greater than 100 mm.

In one embodiment, a barrier system for electrostatically separating adjacent reservoirs in a robotic painting apparatus for conductive materials is provided. The barrier system comprises a physical barrier formed from an electrical insulating material, wherein the barrier is disposed between the adjacent reservoirs such that there is no straight line path from one reservoir to the other reservoir that does not pass through the barrier.

In another embodiment, a barrier system for electrostatically insulating a first paint reservoir from an adjacent second paint reservoir in a robotic painting apparatus for conductive materials is provided. The barrier system comprises a physical barrier formed from an electrical insulating material having a dielectric strength greater than 300 V/mil, the barrier formed from multiple components to facilitate installation and maintenance thereof. The barrier is disposed between the first and second adjacent paint reservoirs such that there is no straight line path from the first paint reservoir to the second paint reservoir that does not pass through the barrier.

In yet another embodiment, a barrier system for electrostatically insulating a first paint reservoir from an adjacent second paint reservoir in a robotic painting apparatus for conductive materials is provided. The barrier system comprises a physical barrier formed from an electrical insulating material having a dielectric strength greater than 300 V/mil, the barrier including a central plate, an upper flange, and a lower flange. The upper flange is disposed on a top surface of the central plate and the lower flange is disposed on a bottom surface of the central plate. The barrier is disposed between the first and second adjacent paint reservoirs such that there is no straight line path from the first paint reservoir to the second paint reservoir that does not pass through the barrier.

DESCRIPTION OF THE DRAWINGS

The above as well as other advantages of the present invention will become readily apparent to those skilled in the art from the following detailed description of a preferred embodiment when considered in the light of the accompanying drawings in which.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner.

Figure 1:
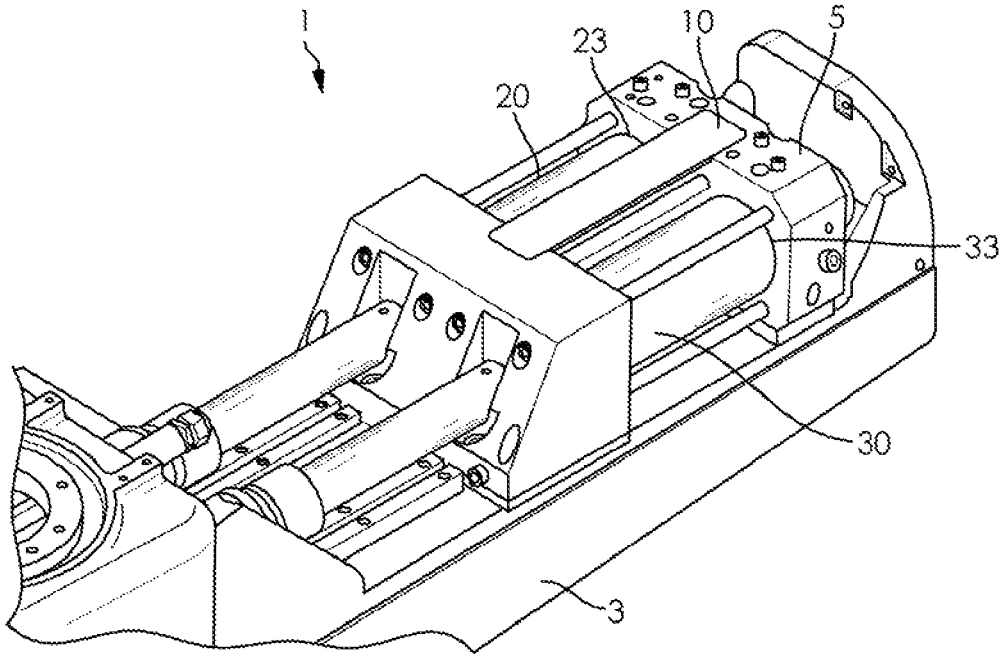
FIG. 1 is a perspective schematic diagram of a barrier system according to the invention mounted with two paint canisters on a robot arm.

FIG. 1 illustrates a robotic painting system 1 according to a preferred embodiment of the invention. The robotic painting system 1 comprises a robot arm 3, a first paint canister 20, a second paint canister 30, and a barrier 10. The barrier 10 is a physical structure formed from an electrical insulating material disposed between the first and second paint canisters 20, 30. The first and second paint canisters 20, 30 are mounted in close proximity to each other on the robot arm 3 in a side-by-side arrangement with longitudinal axes generally extending parallel, physically separated from each other by the barrier 10. A first end 23 of the first paint canister 20 and a first end 33 of the second paint canister 30 are disposed adjacent and in communication with a fixed manifold block 5 having valves (not shown) and passages (not shown) therein for controlling a flow of a conductive paint into each of the canisters 20, 30.

As shown, the first and second paint canisters 20, 30 are generally hollow cylindrical containers having an equivalent size and shape. Furthermore, a longitudinal axis of the first paint canister 20 is generally arranged parallel to a longitudinal axis of the second paint canister 30, and both the first end 23 of the first paint canister 20 and the first end 33 of the second paint canister 30 intersect a common line drawn transverse to the longitudinal axes of the parallel first and second paint canisters 20, 30. However, it should be understood that other arrangements of the first and second paint canisters 20, 30 may be used within the scope of the instant invention, as desired, including arrangements where the first and second paint canisters 20, 30 are not positioned parallel to each other.

Figure 2:
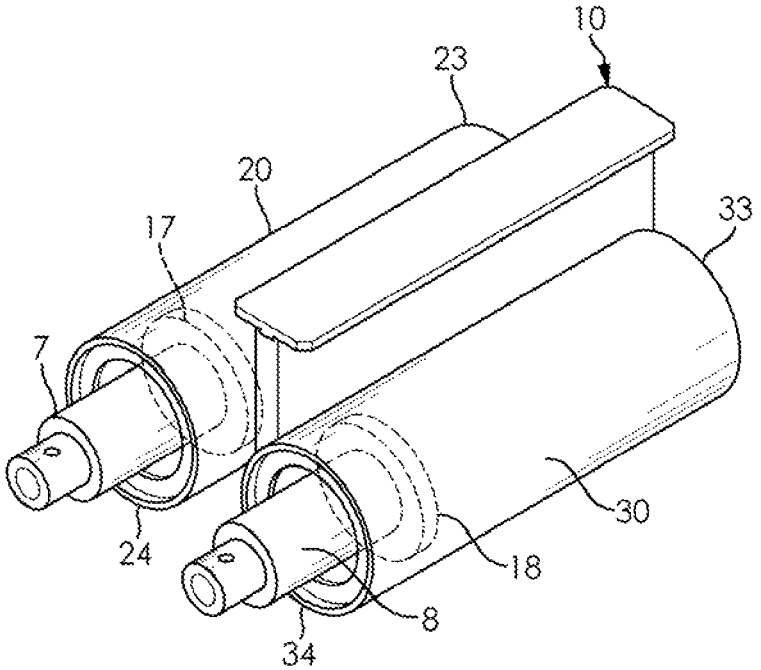
FIG. 2 is a perspective view of the paint canisters and the barrier illustrated in FIG. 1, where the paint canisters are presented in a partial phantom view.

Referring now to FIG. 2, an open second end 24 of the first paint canister 20 includes a first piston 7 slidably disposed therein and an open second end 34 of the second paint canister 30 includes a second piston 8 slidably disposed therein. Each of the pistons 7, 8 slide within the paint canisters 20, 30 respectively similar to a syringe, allowing each of the paint canisters 20, 30 to have a variable internal volume depending on a displacement of each respective piston 7, 8 within each respective paint canister 20, 30. Each of the pistons 7, 8 may be used to control dispensing a volume of a fluid within each of the paint canisters 20, 30 during a painting process, including but not limited to air, the conductive paint, and potentially a solvent for cleaning an interior of each of the paint canisters 20, 30 following a paint application.

Figure 4:
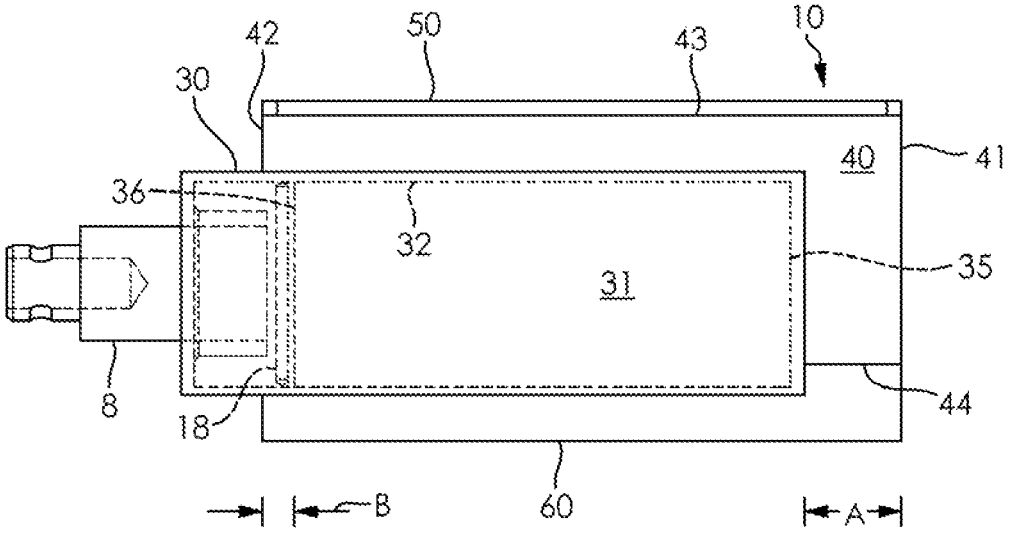
FIG. 4 is a side view of the reservoirs and the barrier illustrated in FIG. 2, where the paint canisters are presented in a partial phantom view.

An interior surface 22 of the first paint canister 20 cooperates with a first piston head 17 of the first piston 7 to form a first paint reservoir 21 within the first paint canister 20 while an interior surface 32 of the second paint canister 30 cooperates with a second piston head 18 of the second piston 8 to form a second paint reservoir 31 within the second paint canister 30, as best shown in FIG. 4 in regards to the second paint canister 30. It should be understood that each of the paint reservoirs 21, 31 has a maximum internal volume, and hence hold a maximum amount of the conductive paint, when each of the pistons 7, 8 are in a fully retracted position, as shown in FIGS. 2 and 4.

The first paint canister 20 is in communication with a first isolation line (not shown) and a conductive paint source (not shown) having conductive paint stored therein having a ground potential. The second paint canister 30 is in communication with a second isolation line (not shown) and the conductive paint source having the ground potential. The first and second isolation lines are used to electrostatically isolate the conductive paint contained within either of the first and second paint canisters 20, 30 from the conductive paint source at preselected intervals during a painting process.

In use, the conductive paint is allowed to flow from the conductive paint source through the first isolation line and into the first paint reservoir 21, wherein the conductive paint contained within the first paint reservoir is also at ground potential during the filling process. When the first paint reservoir 21 is filled, a series of valves (not shown) may be used to stop a flow of the conductive paint from the conductive paint source into the first paint reservoir 21. The first isolation line then allows the conductive paint contained within the first paint reservoir 21 to be isolated from the conductive paint source having the ground potential. The conductive paint contained within the first paint reservoir 21 may then be electrostatically charged to have a potential greater than ground potential. Once electrostatically charged, the conductive paint contained within the first paint reservoir 21 may then be dispensed therefrom to a paint applicator (not shown) disposed on the robot arm 3 for painting an object (not shown).

While the first paint canister 20 is being used for the painting application, the second paint reservoir 31 of the second paint canister 30 can then be filled using the second isolation line and the conductive paint source having the ground potential in a manner identical to that described hereinabove in reference in the first paint canister 20. The conductive paint contained within the second paint reservoir 31 may then be isolated from the conductive paint source having the ground potential such that the conductive paint contained within the second paint reservoir 31 may be electrostatically charged to a potential greater than the ground potential. The electrostatically charged conductive paint contained within the second paint reservoir 31 may then be supplied to the paint applicator for application to the article. It should be understood that this process may be repeated in turn for a number of cycles, as needed, to complete the painting process.

The use of the two paint canisters 20, 30 allows for the robotic paint system 1 to apply the conductive paint to an object without unnecessary delay because one of the paint canisters 20, 30 is supplying the electrostatically charged conductive paint to the paint applicator while the other paint canister 20, 30 is being filled with the conductive paint at ground potential.

However, the use of the two paint canisters 20, 30 in such a manner presents an additional concern due to the electrostatic charging of the conductive paint contained within one of the paint canisters 20, 30 during a filling of the other paint canister 20, 30. As described hereinabove, one of the paint canisters 20, 30 may be filled with the electrostatically charged conductive paint while the other paint canister 20, 30 is filled with the conductive paint at the ground potential, causing a significant voltage difference between the first and second paint canisters 20, 30. This voltage difference causes a very strong electric field that may deteriorate components of the robotic paint system 1 in proximity to the electric field. For this reason, the barrier 10 is provided to further insulate the first paint canister 20 from the second paint canister 30.

Figure 3:
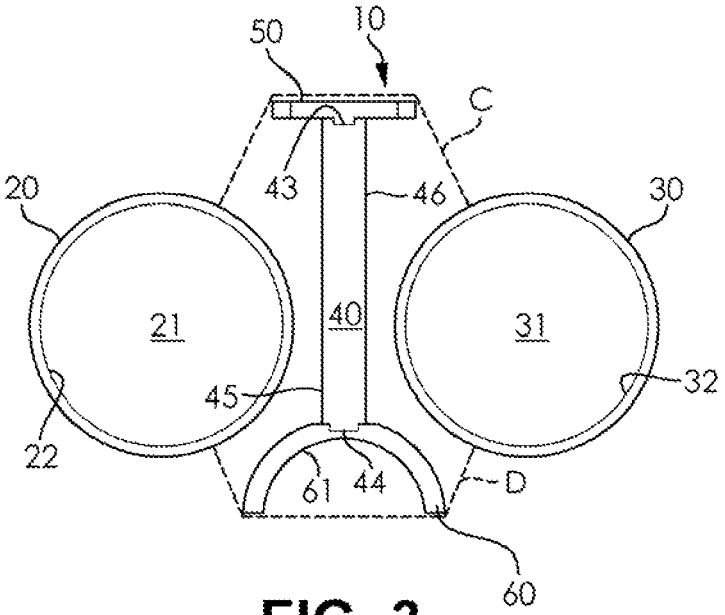
FIG. 3 is an end view of the paint canisters and the barrier illustrated in FIG. 2.

FIG. 3 shows an end view of the barrier 10 and the two cylindrical canisters 20, 30 in side-by-side arrangement. As shown, the barrier 10 is disposed between and equidistant from the closest surface area of each of the first canister 20 and the second canister 30. The barrier 10 is preferably formed from a plurality of components to facilitate installation and maintenance thereof. The barrier 10 comprises a central plate 40, an upper flange 50, and a lower flange 60.

Referring now to FIGS. 3 and 4, the central plate 40 is generally rectangular and elongated in a direction parallel to an orientation of the longitudinal axes of the two cylindrical paint canisters 20, 30. The central plate 40 includes a first end surface 41 and an opposing second end surface 42, a top surface 43 and an opposing bottom surface 44, and a first side surface 45 and an opposing second side surface 46. However, it should be understood that any shape and orientation of the central plate may be utilized, as desired. A thickness of the central plate 40 is defined as a distance measured between the first side surface 45 and the second side surface 46. The thickness of the central plate 40 may be selected to provide a desired dielectric strength of the central plate 40.

It should also be understood that the dielectric strength of a material may be directly affected by a thickness of the material in the direction the material is being subjected to an electric field. For instance, the dielectric strength of an insulating material often decreases as the thickness of the insulating material is increased. In other cases, the dielectric strength of an insulating material may decrease when the thickness of the insulating material is decreased to such an extent that the insulating material becomes more conductive due to the effect of electron tunneling. Additionally, the conditions in the ambient environment may affect the dielectric strength of an insulating material. For instance, the dielectric strength of an insulating material may be affected by the temperature and humidity (if gaseous) of the environment surrounding the insulating material as well as the orientation and position of any conductive components adjacent the insulating material.

Accordingly, the thickness and hence the dielectric strength of the central plate 40 should be selected to militate against deterioration of the robotic paint system 1 based on the operating conditions of the robotic paint system 1.

As shown, the upper flange 50 is generally a rectangular plate extending in a plane oriented perpendicular to a plane of the central plate 40 and is disposed along the top surface 43 of the central plate 40, forming a T-shaped profile. As shown in FIG. 3, the upper flange 50 extends laterally beyond each of the first side surface 45 and the second side surface 46 of the central plate 40. A distance the upper flange 50 extends laterally beyond either of the sides surfaces 45, 46 may be selected depending on the position and orientation of any conductive components adjacent the barrier 10. As shown in FIG. 4, the upper flange 50 extends along the top surface 43 of the central plate 40 from the first end surface 41 to the second end surface 42. It should be understood that the upper flange 50 may extend laterally beyond or end short of either or both of the first end surface 41 and the second end surface 42, as desired. It should also be understood that a thickness of the upper flange 50 may be selected based on the same factors used to select the thickness of the central plate 40.

The lower flange 60 is shown in FIG. 3 as being a curved or arcuate sheet of material coupled to and disposed along the bottom surface 44 of the central plate 40. Similar to the upper flange 50, the lower flange 60 extends laterally beyond each of the first side surface 45 and the second side surface 46 of the central plate 40. The lower flange 60 also extends from the first end surface 41 to the second end surface 42 of the central plate 40. However, the upper flange 60 may extend beyond or end short of either or both of the first end surface 41 and the second end surface 42 of the central plate 40, as desired. As shown, the arcuate shape of the lower flange 60 causes a bottom surface 61 of the lower flange 60 to be semi-circular in profile to receive a cylindrical component of the robot arm 3 therein for coupling the lower flange 60 to the robot arm 3. It should be understood, however, that different configurations of the robot arm 3 may necessitate the lower flange 60 being planar in a manner similar to the upper flange 50. It should also be understood that any shape and orientation of the lower flange 60 may be selected to allow for an ease of installation of the lower flange 60 on the robot arm 3. It should also be understood that a thickness of the lower flange 60 may be selected based on the same factors used to select the thickness of the central plate 40.

Referring now to FIG. 4, a side view of the position and orientation of the barrier 10 relative to the second paint canister 30 is shown, wherein the second piston 8 is in a fully retracted position and the second paint reservoir 31 is completely full of the conductive paint. The first end surface 41 of the central plate 40 extends beyond a first end 35 of the completely filled second paint reservoir 31 by a distance A in a direction parallel to the longitudinal axes of each of the central plate 40 and the second paint canister 30. The distance A is selected to ensure that the barrier 10 extends beyond the second paint reservoir 31 a sufficient distance to ensure that the barrier 10 is disposed entirely between the first and second paint reservoirs 21, 31 while further preventing the electric field caused by the voltage difference between the first and second paint reservoirs 21, 31 from bypassing the barrier 10. Favorable results have been found when the distance A is at least 10 mm in length.

FIG. 4 also shows that the second end surface 42 of the central plate 40 also extends beyond a second end 36 of the second paint reservoir 31 by a distance B. Again, favorable results have been found when the distance B is at least 10 mm in length. It should be understood that the upper and lower flanges 50, 60 also extend past the ends of the second paint reservoir 31 by the distances A and B, respectively. Furthermore, it should be understood that the first paint canister 20 and the first paint reservoir 21 are positioned relative to the barrier 10 in a similar fashion on the opposite side of the barrier 10, ensuring that the barrier 10 is positioned symmetrically between the first and second paint reservoirs 21, 31. Accordingly, the first end surface 41 and the second end surface 42 of the central plate 40 also extend beyond each longitudinal end of the first paint reservoir 21 by the distances A and B, respectively.

FIGS. 1-4 show an arrangement where the barrier 10, the first paint canister 20, and the second paint canister 30 are arranged with longitudinal axes parallel to each other. It should be understood that the barrier 10 may be used in a robotic painting system where the first and second paint canisters 20, 30, and hence the first and second paint reservoirs 21, 31, are not arranged parallel to each other. In such cases, a first end of the barrier 10 preferably extends at least 10 mm beyond each of the first paint reservoir 21 and the second paint reservoir 31 in a first direction perpendicular to a shortest straight line path from the first paint reservoir 21 to the second paint reservoir 31. Furthermore, a second end of the barrier 10 also preferably extends at least 10 mm beyond each of the first paint reservoir 21 and the second paint reservoir 31 in a second direction perpendicular to the shortest straight line path from the first paint reservoir 21 to the second paint reservoir 31. The second direction may, for instance, be a direction opposite of the first direction.

As can be seen in FIGS. 3 and 4, the arrangement of the barrier 10 relative to the first and second paint canisters 20, 30 causes it to be impossible to draw a straight line from any point within the first paint reservoir 21 to any point within the second paint reservoir 31 without passing through the barrier 10. Accordingly, the barrier 10 electrostatically separates the adjacent first and second paint reservoirs 21, 31 from each other. The position of the barrier 10 prevents deterioration of proximate components of the robotic paint system 1 by preventing the electric field formed by the electrostatically charged conductive paint located within one of the first and second paint reservoirs 21, 31 from passing through the barrier 10. The barrier 10 also prevents formation of a ground path or short circuit between the adjacent first and second paint reservoirs 21, 31, wherein the ground path or short circuit may prevent the effective charging of the paint reservoir 21, 31 that is dispensing the conductive paint to the object being painted.

Furthermore, the shortest path along any surface from the first paint reservoir 21 to the second paint reservoir 31 is preferably greater than a preset distance value, as best illustrated in FIG. 3, which shows a path C and a path D in dashed lines between the first paint reservoir 21 and the second paint reservoir 31. Path C represents the shortest possible path between a top surface of the first paint reservoir 21 and a top surface of the second paint reservoir 31 while path D represents the shortest possible path between a bottom surface of the first paint reservoir 21 and a bottom surface of the second paint reservoir 31. Favorable results have been found when the path distance value is equal to or greater than 100 mm. However, it should be understood that other path distance values may be selected depending on the arrangement of the components of the robotic painting system 1.

FIGS. 1-4 show an arrangement where the barrier 10, the first paint canister 20, and the second paint canister 30 are arranged in parallel to each other. It should be understood that the barrier 10 may be used with any arrangement of components of the robotic painting system 1 so long as the barrier 10 remains between the first and second paint reservoirs 21, 31 such that a straight line path cannot be drawn from the first paint reservoir 21 to the second paint reservoir 31 without passing through the barrier. Furthermore, in arrangements where the barrier 10, the first paint reservoir 21, and the second paint reservoir 31 are not arranged in parallel, a length of the barrier 10 measured in a direction perpendicular to the shortest straight line path between the adjacent first and second paint reservoirs 21, 31 is preferably greater than a length of each of the adjacent first and second paint reservoirs 21, 31 measured in the direction perpendicular to the shortest straight line path between the adjacent first and second paint reservoirs 21, 31. The length of the barrier 10 in the direction perpendicular to the shortest straight line path may be, for instance, 10 mm or greater than the length of each of the first and second paint reservoirs 21, 31 measured in the same direction.

The three part construction of the barrier 10 allows the barrier 10 to be easily installed into the robot arm 3. As can be seen in FIG. 3, the first and second paint canisters 20, 30 may be in close proximity to the barrier 10 and specifically the central plate 40. The three part construction of the barrier 10 allows for the central plate 40, the upper flange 50, and the lower flange 60 to be assembled in any order to accommodate any surrounding structure of the robot arm 3 that may interfere with installation of the barrier 10 completely assembled. Furthermore, the three part construction may allow for ease of maintenance to either or both of the robot arm 3, the first and second paint canisters 20, 30, and the barrier 10 as the individual components 40, 50, 60 of the barrier 10 may be removed separately to allow for access to selected regions of the robot arm 3. The upper flange 50 and the lower flange 60 may be coupled to the central plate 40 using any known traditional coupling means, including bonding, fastening means, and interfitting components, for example.

The central plate 40, upper flange 50, and lower flange 60 of the barrier 10 are preferably all formed from the same insulating material. As explained hereinabove, the insulating material must have an intrinsic dielectric strength sufficient to prevent deterioration of any components of the robotic paint system 1 caused by a voltage difference between the conductive paint contained within the first and second paint reservoirs 21, 31. Favorable results have been found when the barrier 10 is formed from an insulating material having a dielectric strength of 300 V/mil or greater. The barrier 10 may also preferably be formed from an insulating material having rigidity sufficient to maintain its form, location, and orientation during use of the robot arm 3. Accordingly, examples of insulating materials suitable for use with the robotic paint system 1 may include polytetrafluoroethylene (PTFE) material and acetal copolymer material.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A robotic painting apparatus including two adjacent paint reservoirs mounted side-by-side on a robot arm and adapted to operate as an electrostatic direct charge painting system, comprising:

an electrostatic barrier formed from an electrical insulating material, the barrier being disposed on the robot arm between the two adjacent paint reservoirs wherein there is no straight line path between the paint reservoirs that does not pass through the barrier, the barrier electrostatically insulating the paint reservoirs from each other thereby preventing formation of a ground path or short circuit between the paint reservoirs.

2. The apparatus according to claim 1 wherein the electrical insulating material has a dielectric strength greater than 300 V/mil.

3. The apparatus according to claim 1 wherein the electrical insulating material is a polytetrafluoroethylene material.

4. The apparatus according to claim 1 wherein the electrical insulating material is an acetal copolymer material.

5. The apparatus according to claim 1 wherein the barrier is shaped to limit a shortest path between the paint reservoirs that does not pass through the barrier to no less than 100 mm.

6. The apparatus according to claim 1 wherein the barrier has a length along a longitudinal axis greater than a longitudinal length of each the adjacent paint reservoirs.

7. The apparatus according to claim 6 wherein the length of the barrier is greater than the longitudinal length of each of the paint reservoirs by at least 10 mm at each longitudinal end of the paint reservoirs.

8. The apparatus according to claim 1 wherein the barrier is assembled from at least two components.

9. The apparatus according to claim 8 wherein the barrier components include a central plate having a top surface and a bottom surface, an upper flange adapted to be attached to the central plate at the top surface, and a lower flange adapted to be attached to the central plate at the bottom surface.

10. A robotic painting apparatus for operation as an electrostatic direct charge painting system for conductive materials, comprising:

a robot arm;

a first paint reservoir and a second paint reservoir mounted side-by-side on the robot arm; and an electrostatic barrier formed from an electrical insulating material having a dielectric strength greater than 300 V/mil, the barrier being assembled from a plurality of components, the barrier being disposed on the robot arm between the first and second paint reservoirs wherein there is no straight line path between the paint reservoirs that does not pass through the barrier, the barrier electrostatically insulating the paint reservoirs from each other thereby preventing formation of a ground path or short circuit between the paint reservoirs.

11. The apparatus according to claim 10 wherein the barrier components include a central plate and an upper flange, wherein the upper flange is disposed on a top surface of the central plate and extends laterally beyond each of a first side surface and a second side surface of the central plate.

12. The apparatus according to claim 10 wherein the barrier components include a central plate and a lower flange disposed on a bottom surface of the central plate, the lower flange extending laterally beyond each of a first side surface and a second side surface of the central plate.

13. The apparatus according to claim 12 wherein the lower flange is configured to be coupled to the robot arm of the robotic painting apparatus.

14. The apparatus according to claim 10 wherein a first end of the barrier extends at least 10 mm beyond a first longitudinal end of each of the paint reservoirs in a direction parallel to a longitudinal axis of each of the paint reservoirs.

15. The apparatus according to claim 14 wherein a second end of the barrier extends at least 10 mm beyond a second longitudinal end of each of the paint reservoirs in the direction parallel to the longitudinal axes of the paint reservoirs.

16. The apparatus according to claim 10 wherein the electrical insulating material is one of a polytetrafluoroethylene material and an acetal copolymer material.

17. The apparatus according to claim 10 wherein the barrier is shaped to limit a shortest path between the first paint reservoir and the adjacent second paint reservoir that does not pass through the barrier to greater than 100 mm.

18. An apparatus for electrostatically insulating two adjacent paint reservoirs mounted on a robot arm of a robotic painting apparatus for conductive materials, comprising:

a first paint reservoir mounted on the robot arm;

a second paint reservoir mounted on the robot arm side-by-side with the first paint reservoir; and an electrostatic barrier formed from an electrical insulating material, the barrier including a central plate having a top surface and a bottom surface, an upper flange disposed on the top surface of the central plate, and a lower flange disposed on the bottom surface of the central plate and mounted to the robot arm, the barrier being disposed with the central plate between the paint reservoirs wherein there is no straight line path between the paint reservoirs that does not pass through the barrier thereby preventing formation of a ground path or short circuit between the paint reservoirs.

19. The apparatus according to claim 18 wherein the central plate has a longitudinal length greater than a longitudinal length of each of the first and second paint reservoirs by at least 10 mm at each longitudinal end of the paint reservoirs.

20. The apparatus according to claim 18 wherein the electrical insulating material has a dielectric strength greater than 300 V/mil.

* * * * *